US007363954B2

(12) United States Patent
Sleiman et al.

(10) Patent No.: US 7,363,954 B2
(45) Date of Patent: Apr. 29, 2008

(54) TAMPING LABELER

(75) Inventors: Joseph Z. Sleiman, Leamington (CA); Peter C. Nielsen, Leamington (CA)

(73) Assignee: Joe & Samia Management (CA)

( * ) Notice: Subject to any disclaimer, the term of this patent is extended or adjusted under 35 U.S.C. 154(b) by 0 days.

(21) Appl. No.: 10/762,269

(22) Filed: Jan. 23, 2004

(65) Prior Publication Data

US 2005/0161164 A1 Jul. 28, 2005

(51) Int. Cl.
*B65C 9/14* (2006.01)
*B65C 9/36* (2006.01)

(52) U.S. Cl. ..... 156/539; 156/556; 156/581; 156/DIG. 31; 156/DIG. 38; 156/DIG. 42

(58) Field of Classification Search ..... 156/539–542, 156/556, 566, 567, 568, DIG. 24, DIG. 37, 156/DIG. 38, DIG. 42; 269/21; 451/388
See application file for complete search history.

(56) References Cited

U.S. PATENT DOCUMENTS

| | | | | | |
|---|---|---|---|---|---|
| 2,723,775 | A | * | 11/1955 | Von Hofe et al. | 269/21 |
| 3,885,705 | A | * | 5/1975 | French | 221/211 |
| 4,244,763 | A | * | 1/1981 | Varon et al. | 156/74 |
| 4,680,082 | A | * | 7/1987 | Kearney | 156/497 |
| 4,844,771 | A | * | 7/1989 | Crankshaw et al. | 156/387 |
| 5,100,491 | A | * | 3/1992 | Ijiri et al. | 156/220 |
| 5,291,692 | A | * | 3/1994 | Takahashi et al. | 451/388 |
| 5,423,716 | A | * | 6/1995 | Strasbaugh | 451/388 |
| 5,645,680 | A | | 7/1997 | Rietheimer | |
| 5,829,351 | A | | 11/1998 | Anderson et al. | |
| 5,833,803 | A | * | 11/1998 | Strohmeyer et al. | 156/517 |
| 6,006,808 | A | * | 12/1999 | Ewert et al. | 156/556 |
| 6,257,294 | B1 | * | 7/2001 | Weisbeck | 156/356 |
| 6,257,564 | B1 | * | 7/2001 | Avneri et al. | 269/21 |
| 2001/0037853 | A1 | * | 11/2001 | Anderson et al. | 156/285 |
| 2002/0189741 | A1 | * | 12/2002 | Nielsen et al. | 156/64 |
| 2005/0039858 | A1 | * | 2/2005 | Arrington | 156/540 |

FOREIGN PATENT DOCUMENTS

| | | | |
|---|---|---|---|
| EP | 0 113 256 | * | 7/1984 |
| EP | 1 396 434 | * | 3/2004 |
| JP | 2-233340 | * | 9/1990 |
| JP | 11-193012 | * | 7/1999 |
| WO | WO 02/102669 A2 | | 12/2002 |
| WO | 03/024807 | * | 3/2003 |

* cited by examiner

*Primary Examiner*—Melvin Mayes
(74) *Attorney, Agent, or Firm*—Warner Norcross & Judd LLP

(57) ABSTRACT

By providing projections extending outwardly from the base of a wet tamping face of a tamping labeler, which projections maintain at least a substantial portion of a label at a stand off from said base, the surface tension between the label and tamping face is reduced. This reduction in surface tension helps ensure that when a label is tamped against a product, it remains there. The tamping face may be provided with a regular, or irregular, pattern of projections, or with a texture that results in the projections.

11 Claims, 4 Drawing Sheets

TAMPING LABELER

BACKGROUND OF INVENTION

This invention relates to a tamping labeler and to a labeling apparatus having tamping labelers.

Products to be sold are commonly labelled. In this regard, automatic labelling apparatus may be employed where the products are smaller and processed in large volumes. One approach in this regard is to wipe a label onto each product as its passes a labelling head. This approach, however, is only well suited for labelling products of uniform dimensions. Where products have irregular dimensions, such that the distance between a given product and the labelling head will vary, tamping labellers are typically used. U.S. Pat. No. 5,829,351 to Anderson discloses such a labeller. In Anderson, a turret carries a number of flexible pneumatic bellows about its periphery. The turret has a vacuum plenum and a positive pressure plenum. The turret rotates each bellows, consecutively, to a labelling station. A bellows normally communicates with the vacuum plenum which keeps it in a retracted position; also, due to end perforations in the bellows, the negative pressure holds a label at the end of the bellows. However, when the bellows reaches the labelling station, it is coupled to the positive pressure plenum which causes a one-way valve to block the perforations and causes the bellows to rapidly extend until it tamps a product below. The force of the tamping forms an adhesive bond between the pressure sensitive adhesive of the label and the product. Labels are fed to each bellows from a label cassette with a label web comprising serially arranged labels on a release tape.

A tamping labeler is suited to the labeling of produce, given the irregular dimensions of produce. However, if the produce is wet, the tamping face of the bellows will also become wet. This can result in the surface tension between the bellows and a label being stronger than the tack adhesion between the produce and the label when the label is tamped against the produce. Should this occur, the label may remain on the bellows. This event may be repeated, such that the bellows may become clogged with a plurality of labels, thereby requiring operator intervention. Even if a bellows does not become clogged, the effectiveness of the labeler is diminished if some labels do not adhere to the produce.

This invention seeks to address this problem.

SUMMARY OF INVENTION

By providing projections extending outwardly from the base of a wet tamping face of a tamping labeler, which projections maintain at least a substantial portion of a label at a stand off from said base, the surface tension between the label and tamping face is reduced. This reduction in surface tension helps ensure that when a label is tamped against a product, it remains there. The tamping face may be provided with a regular, or irregular, pattern of projections, or with a texture that results in the projections.

According to the present invention, there is provided a tamping labeler for use in a labeling apparatus, comprising: a tamping face having a base and projections projecting outwardly from said base for maintaining at least a substantial portion of a label at a stand off from said base.

According to another aspect of the present invention, there is provided a bellows for use in a labeling apparatus, comprising: a tamping face having a base and projections projecting outwardly from said base for maintaining a label at a stand off from said base.

According to a further aspect of the present invention, there is provided a bellows for use in a labeling apparatus, comprising: a tamping face having projections for reducing surface tension between a label held by vacuum to said tamping face and said tamping face when said tamping face is wet.

According to another aspect of the present invention, there is provided a product labeling apparatus, comprising: an indexing turret carrying a plurality of tamping labelers, each tamping labeler having a tamping face with a base and projections projecting outwardly from said base for maintaining at least a substantial portion of a label at a stand off from said base; a vacuum chamber in fluid communication with each tamping labeler other than at a labeling station; a positive pressure chamber in fluid communication with a tamping labeler at said labeling station; a label supply for supplying a label to a tamping face of a tamping labeler at a label supply station spaced from said labeling station.

Other aspects and features of the invention will become apparent by reference to the following description in conjunction with the drawings.

BRIEF DESCRIPTION OF THE DRAWING

In the figures which illustrate example embodiments of the invention.

DETAILED DESCRIPTION

Figure 1:
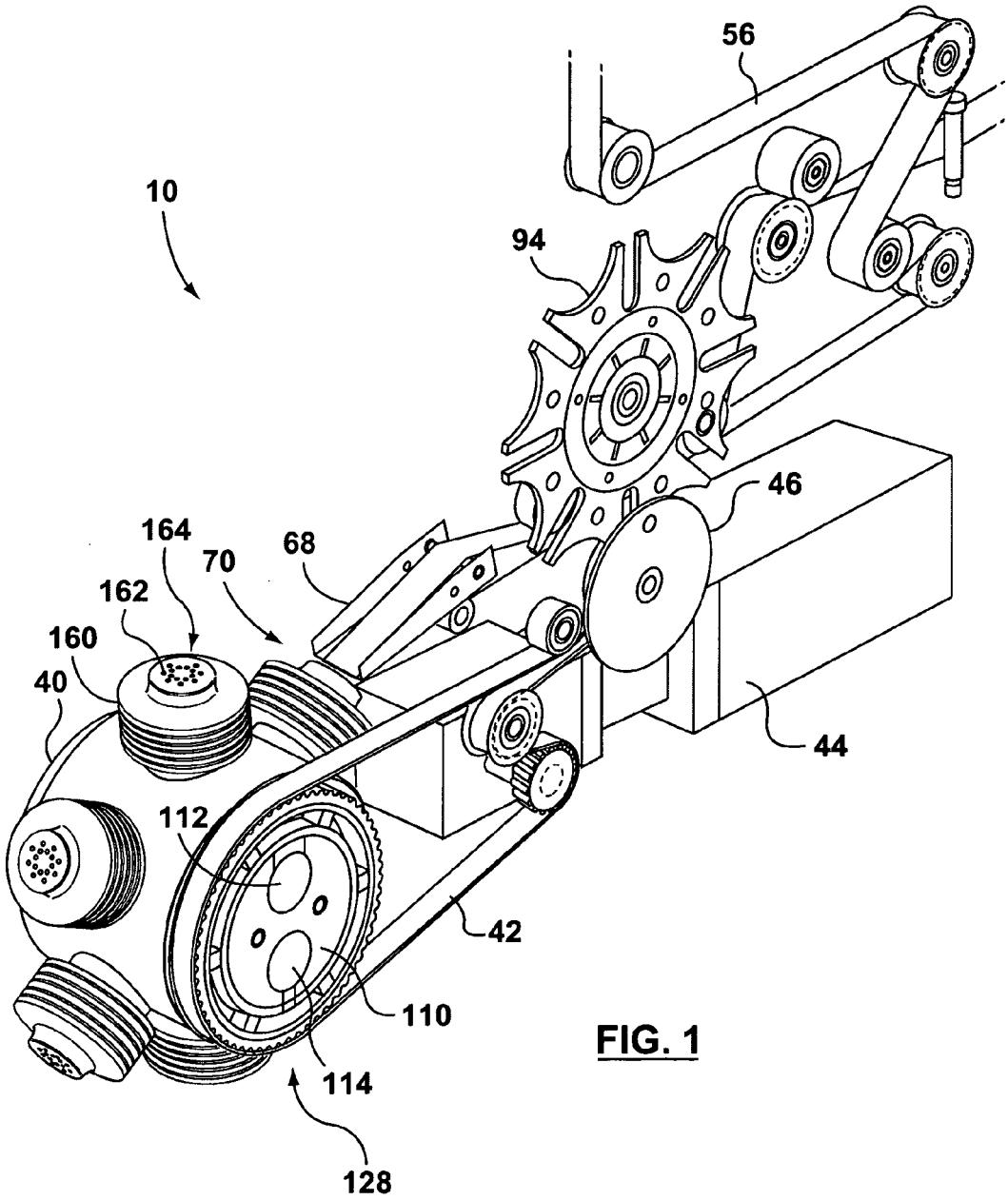
FIG. 1 is a perspective view of a labeling apparatus made in accordance with this invention.

Referencing FIG. 1, a labeling apparatus 10 comprises a rotatably mounted turret 40 connected to a stepper motor 44 by a belt drive 42. A label web 56 comprises a release tape carrying a plurality of labels 60 (FIG. 4) backed with a pressure sensitive adhesive. The label web extends along a U-channel member 68 to a label pick-up station 70. The label web 56 is advanced by a gear 94 that is intermittently driven by stepper motor 44 through a pin wheel 46.

The turret carries a plurality of bellows 160. Each bellows is fabricated of a flexible material, such as rubber or silicone. The tamping face 162 of each bellows is perforated with holes 164. A one-way valve 166 (FIG. 4) is disposed inside each bellows proximate holes 164.

Turret 40 has a stationary core 110 with a port 112 for connection to a vacuum source (not shown) and a port 114 for connection to a source of positive pressure (not shown). The internal configuration of core 110 is such that each bellows is fluidly coupled to port 112 through most of its rotation about core 110 but is instead fluidly coupled to port 114 when a bellows is at the label applying station 128.

Further details of the construction of the labeling apparatus 10 as described so far may be found in WO 02/102669 to Neilsen and Sleiman, published Dec. 27, 2002, the contents of which are incorporated herein by reference.

Figure 3:
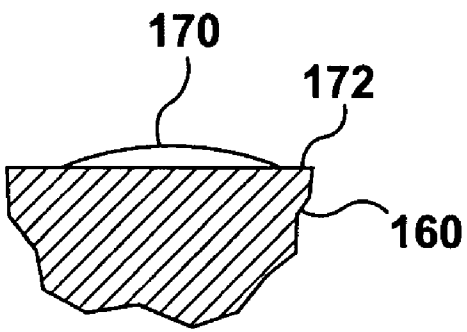
FIG. 3 is a fragmentary view of a tamping face of a tamping labeler of the apparatus of FIG. 1, FIGS. 4 and 5 are schematic side views of the turret of the labeling apparatus of FIG. 1, illustrating operation of the labeling apparatus.
Figure 2:
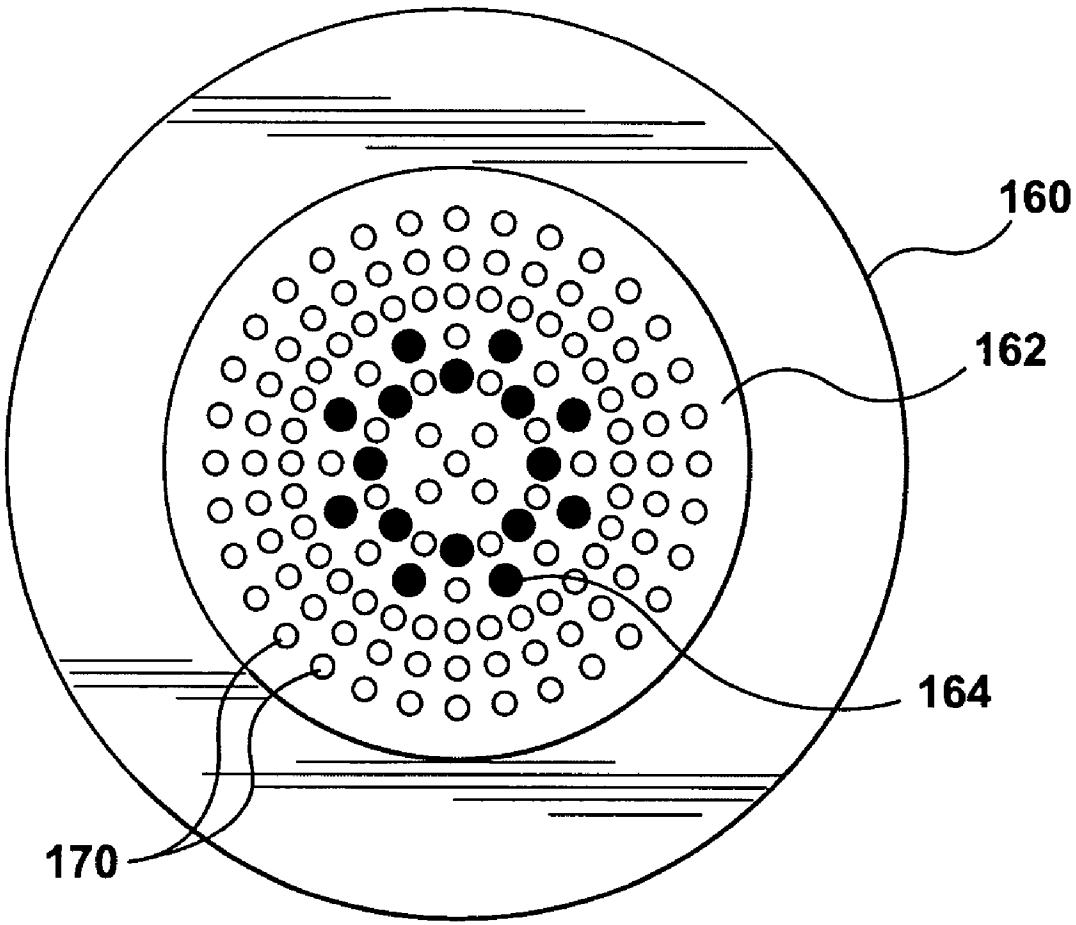
FIG. 2 is a plan view of a tamping face of a tamping labeler of the apparatus of FIG. 1.

Turning to FIGS. 2 and 3, a plurality of projections in the nature of domes 170 extend outwardly from a base 172 of the tamping face 162. The domes are patterned across the face 162 of the bellows 160 and are arranged such that each hole 164 is partially surrounded by domes. By way of example, the domes may have a height of about 5 thousandths of an inch (125 microns) above the base 172 of the tamping face 162 and a diameter of about 50 thousandths of an inch (1.25 mm). In one embodiment, illustrated in FIG. 2, the domes are arranged on the face such that they are mutually exclusive of the vacuum holes 164.

Figure 4:
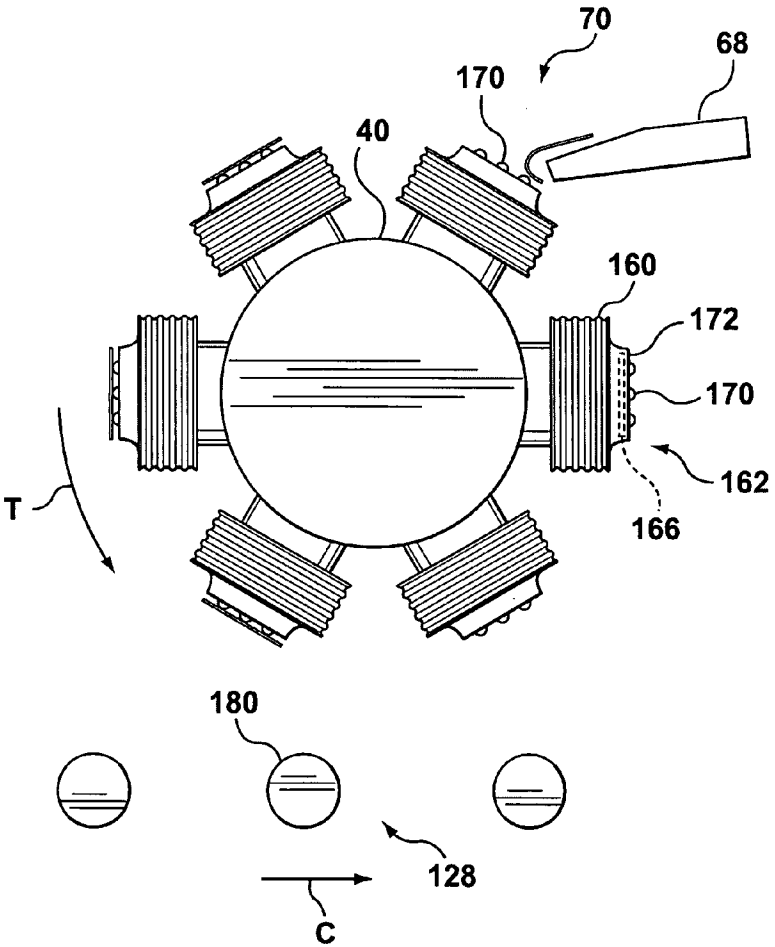

With reference to FIG. 4, a bellows 160 and a label 60 are advanced to the label supply station 70 whereat the label 60 is sucked onto the tamping face 162 of the bellows by a vacuum communicated from port 112 (FIG. 1) to the bellows and through to the tamping face by holes 164 (FIG. 2) through the tamping face. However, the domes 170 maintain the label 60 at a stand off from the base 172 of the tamping face. In this way, all bellows upstream of the label applying station 128 are loaded with labels 60.

Figure 5:
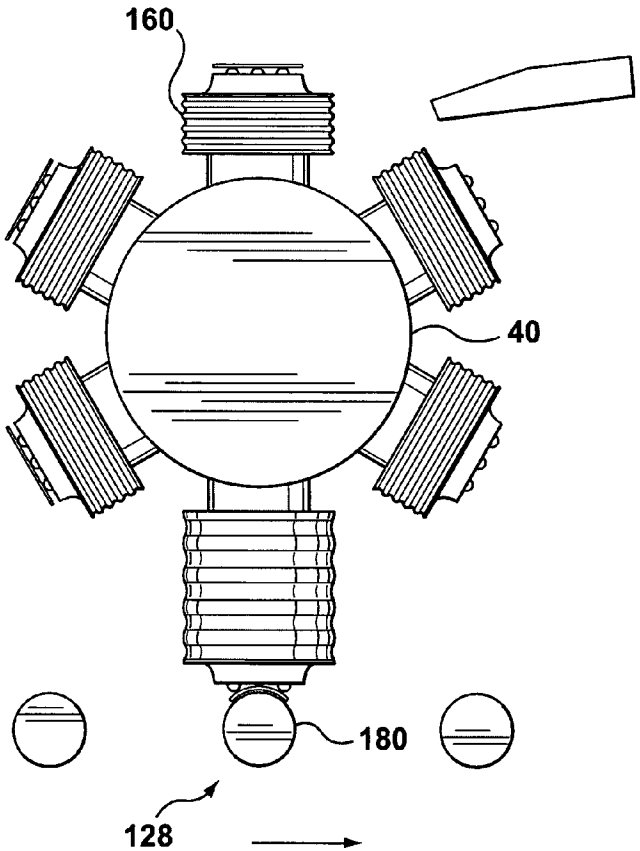

The turret 40 is indexed (in direction T) past the label applying station 128 at a time when a product, such as item of produce 180 (being conveyed in direction C), is at the label applying station. As the bellows passes through the label applying station, it is coupled to a source of positive pressure through port 114 (FIG. 1), which causes the bellows to extend to tamp the product. This operation is illustrated in FIG. 5. During the extension, the one-way valve 166 in the bellows blocks holes 164 so that the label is not blown off the tamping face 162 of the bellows. The pressure sensitive adhesive then adheres the label to the product as the bellows rotates past the label applying station and is retracted due to again being coupled to a vacuum source.

If the products are wet, the tamping face of the bellows will become wet as-well. In consequence, water will be interposed between fresh labels taken up by the bellows and the tamping face of the bellows. The resulting surface tension must be overcome by the strength of the adhesive bond between the product and the label at the label applying station in order for the label to remain on the product and not on the bellows. The domes 170, by providing a stand-off between the label and the (wet) base 172 of the tamping face 162 of the bellows, reduce this surface tension so that the labels will remain adhered to products. It will be apparent that, if necessary, the height of the domes could be increased to ensure this result.

It may be possible to provide a (regular or irregular) pattern of domes such that only a substantial portion of a label was maintained at a stand-off from the base of a tamping face of a bellows. In such instance, the surface tension between the label and bellows would be increased, but provided it were insufficient to overcome the tack adhesion of the label to the product, this would not be problematic.

Figure 6:
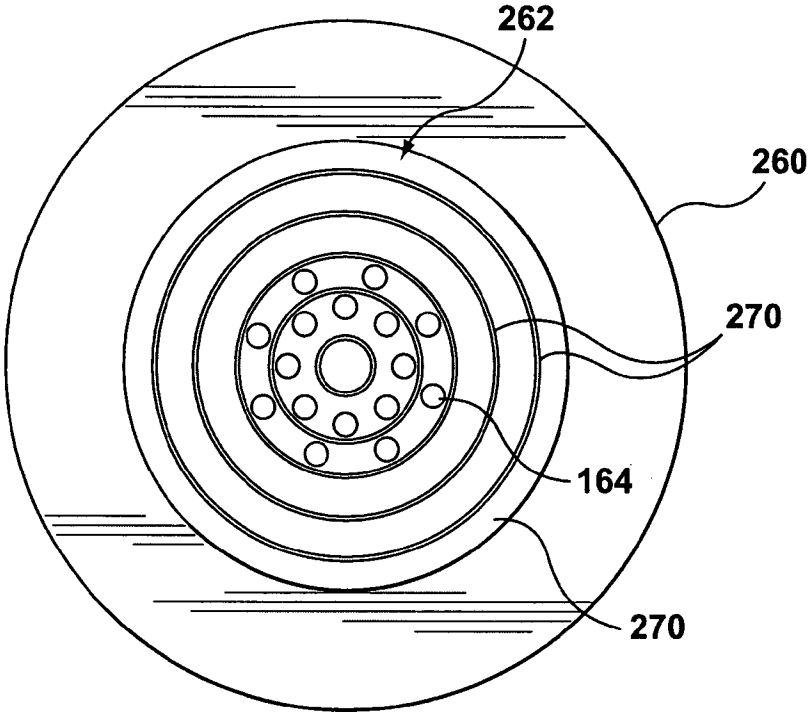
FIG. 6 is a plan view of an alternate tamping face for a tamping labeler which may be used with the apparatus of FIG. 1.

With reference to FIG. 6, in place of a pattern of domes across the tamping face of a bellows, the face 262 of a bellows 260 may be provided with a pattern of concentric ridges 270. The spacing of these ridges would be chosen to at least substantially maintain a label at a stand-off from the base 272 of the tamping face 262.

Figure 7:
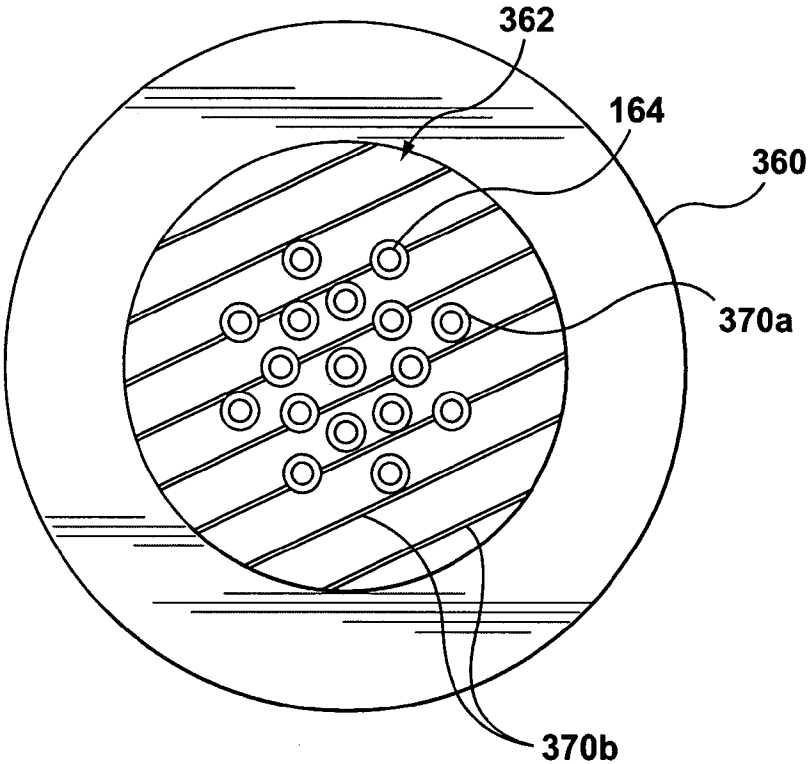
FIG. 7 is a plan view of a further tamping face for a tamping labeler which may be used with the apparatus of FIG. 1.

With reference to FIG. 7, as a further alternative, a circular ridge 370*a* could surround each hole 164 in a bellows 360. Further, a pattern of linear ridges 370*b* could extend across other portions of the tamping face 362 of the bellows 360. Again, the spacing of these ridges would be chosen to at least substantially maintain a label at a stand-off from the base of the tamping face 362.

As a further alternative, the tamping face may textured such that the texture results in the projections.

While the tamping labeler described in conjunction with the invention is a bellows, it will be appreciated that the teachings of this invention may be applied to any other type of tamping labeler that is used in a wet environment. For example, this invention has application to a tamping labeler which is in the nature of a spring biased piston, as described in U.S. Pat. No. 5,645,680 to Rietheimer. In Rietheimer, the piston is released by a cam so that it extends under the force of the spring to tamp a product at a label applying station.

Other modifications will be apparent to those skilled in the art and, therefore, the invention is defined in the claims.

What is claimed is:

1. A tamping labeler for use in a labeling apparatus, comprising:

a tamping face that is movable from a retracted position to an extended tamping position, said tamping face having a base including a plurality of vacuum holes and a plurality of discrete projections projecting outwardly from said base for maintaining at least a substantial portion of a label at a stand off from said base, none of said projections extending completely across said base in any direction nor completely surrounding one of said vacuum holes, said projections being mutually exclusive of said vacuum holes.

2. The tamping labeler of claim 1 wherein said projections are arranged such that each hole is partially surrounded by at least one of said projections.

3. The tamping labeler of claim 1 wherein at least some of said projections are ridges.

4. The tamping labeler of claim 1 wherein at least some of said projections are domes.

5. The tamping labeler of claim 1 wherein said tamping face is textured and said projections result from the texture of said tamping face.

6. A tamping labeler for use in a labeling apparatus, comprising:

a tamping face that is movable from a retracted position to an extended tamping position, said tamping face having a base including a plurality of vacuum holes and a plurality of discrete projections projecting outwardly from said base for maintaining at least a substantial portion of a label at a stand off from said base, said projections projecting from said base and all of said projections having the same height, said projections each extending over only a portion of said base and not completely surrounding said vacuum holes, said projections being mutually exclusive of said vacuum holes, said tamping labeler further comprising flexible accordion sides for allowing said tamping labeler to extend and retract.

7. The tamping labeler of claim 6 further comprising a one-way valve for blocking said holes when a positive pressure is introduced into said tamping labeler.

8. A bellows for use in a labeling apparatus, comprising:

a bellows;

tamping means for extending and retracting said bellows; and a tamping face on said bellows, said tamping face having a base including a plurality of vacuum holes and a plurality of projections projecting outwardly from said base, none of said projections extending completely across said base in any direction nor completely surrounding one of said vacuum holes, said projections being mutually exclusive of said vacuum holes for reducing surface tension between a label held by vacuum to said tamping face when said tamping face is wet.

9. The labeling apparatus labeler of claim 8 wherein at least some of said projections are domes.

10. The labeling apparatus of claim 9 further comprising a one-way valve for blocking said holes when a positive pressure is introduced into said tamping labeler.

11. The labeling apparatus of claim 10 wherein said tamping face is textured and said projections result from the texture of said tamping face.

* * * * *

UNITED STATES PATENT AND TRADEMARK OFFICE

CERTIFICATE OF CORRECTION

PATENT NO. : 7,363,954 B2
APPLICATION NO. : 10/762269
DATED : April 29, 2008
INVENTOR(S) : Joseph Z. Sleiman et al.

It is certified that error appears in the above-identified patent and that said Letters Patent is hereby corrected as shown below:

Column 4, Claim 8, Line 63:
delete "bellows for use in a"

Signed and Sealed this

Twenty-sixth Day of August, 2008

JON W. DUDAS
*Director of the United States Patent and Trademark Office*